US008549707B2

(12) United States Patent
Macernis

(10) Patent No.: US 8,549,707 B2
(45) Date of Patent: Oct. 8, 2013

(54) HINGE

(76) Inventor: Audrius Macernis, Mount Eliza (AU)

( * ) Notice: Subject to any disclaimer, the term of this patent is extended or adjusted under 35 U.S.C. 154(b) by 222 days.

(21) Appl. No.: 13/026,718

(22) Filed: Feb. 14, 2011

(65) Prior Publication Data

US 2011/0239406 A1 Oct. 6, 2011

(30) Foreign Application Priority Data

Feb. 12, 2010 (AU) ..... 2010900559

(51) Int. Cl.
*E05F 1/08* (2006.01)

(52) U.S. Cl.
USPC ..... 16/301; 16/298; 16/50

(58) Field of Classification Search
USPC ..... 16/50, 354, 298, 299, 300, 301, 79, 76
See application file for complete search history.

(56) References Cited

U.S. PATENT DOCUMENTS

| | | | | | |
|---|---|---|---|---|---|
| 244,185 | A | * | 7/1881 | Clark et al. | 16/300 |
| 308,337 | A | * | 11/1884 | Alexander | 16/300 |
| 4,073,038 | A | * | 2/1978 | Curry et al. | 16/301 |
| 5,572,768 | A | * | 11/1996 | Daul | 16/49 |

FOREIGN PATENT DOCUMENTS

| | | |
|---|---|---|
| AU | 666491 | 3/1993 |

* cited by examiner

*Primary Examiner* — Jeffrey O Brien
(74) *Attorney, Agent, or Firm* — Joseph Stecewycz

(57) ABSTRACT

A hinge including first and second hinge members movable between an open position and a closed position, the first hinge member including a substantially cylindrical body portion having a longitudinal axis about which the second hinge member is rotatable to move the hinge between the open position and the closed position; the body portion housing biasing means having an end fixed relative to the second hinge member, the biasing means being in engagement with an adjustment member, the adjustment member being fixed with respect to the first hinge member; wherein the adjustment member includes a ratchet means to move the adjustment member in a first direction to increase the tension in the biasing means.

6 Claims, 2 Drawing Sheets

HINGE

CROSS-REFERENCE TO RELATED APPLICATION

The present application claims priority under 35 U.S.C. 119 from Australian Patent Application No. 2010900559, filed on Feb. 12, 2010, the contents of which are incorporated herein by reference.

FIELD OF THE INVENTION

The present invention relates to improvements in hinges, and is particularly, though not exclusively, applicable to hinges for self-closing gates and doors.

BACKGROUND TO THE INVENTION

Self-closing (and self-opening) gates are in common use, particularly in situations which require increased safety. For example, it is mandatory in some countries to provide self-closing gates for swimming pool fences, to prevent unsupervised access by small children in the event that other persons have forgotten to close the gate. Similarly, self-closing gates are often employed in households to prevent toddlers from accessing stairways and other potentially hazardous areas.

Gates of this type generally include a helical spring-loaded hinge which produces a torque to bias the hinge towards the closed (or open, as the case may be) position. A problem which arises in relation to such gates is that they vary in dimension and weight, and so the spring tension in the hinge must be adjusted accordingly in order to have the gate close or open at appropriate speed.

One solution to the problem, as proposed by Australian patent no. 666491, is to provide a coupling element connected to the spring. The coupling element includes a head portion with a circular top section and a hexagonal intermediate section which engages a matching hexagonal engagement surface in an aperture of the spring housing. The top section includes a slot to accommodate a screwdriver. When it is desired to adjust the spring tension, the person installing the gate inserts a screwdriver into the slot and applies pressure to disengage the coupling element so that it can be turned to a different orientation. A disadvantage of this arrangement is that it requires the simultaneous application of a linear force along the spring axis and a rotational force about the spring axis. This is a relatively unnatural movement which can cause inconvenience to the installer. Use of a screwdriver can also cause inconvenience in that the knuckles on the installer's hand may be obstructed by the hinge or the gate to which it is mounted.

It is therefore desirable to provide a hinge which has adjustable tension, but which is easier to install and adjust than known hinges of the type described above.

SUMMARY OF THE INVENTION

Accordingly, the present invention provides, in one aspect, a hinge including first and second hinge members movable between an open position and a closed position, the first hinge member including a substantially cylindrical body portion having a longitudinal axis about which the second hinge member is rotatable to move the hinge between the open position and the closed position;

the body portion housing biasing means having an end fixed relative to the second hinge member, the biasing means being in engagement with an adjustment member, the adjustment member being fixed with respect to the first hinge member;

wherein the adjustment member includes a ratchet means to move the adjustment member in a first direction to increase the tension in the biasing means.

Preferably, a first end of the biasing means is fixed relative to the second hinge member and a second end of the biasing means is engaged with the adjustment member.

The unidirectional movement of the ratchet means allows an installer to apply a purely rotational force in order to increase the spring tension. This provides for a much easier tension adjustment method than in known arrangements.

In a particularly preferred embodiment, the ratchet means is a releasable ratchet means.

The releasability of the ratchet means allows the tension to be reset to its initial level without disassembling the hinge.

In another preferred embodiment, the ratchet means includes a plurality of asymmetric teeth, each of the teeth having a first inclined face which is adapted to slide in the first direction over one or more stops located on the internal surface of the body portion, and a second face which is engageable with any one of the stops to fix the position of the second end of the biasing means relative to the first hinge member.

Preferably, the adjustment member includes a tool-engaging surface (in the form of a recess or projection) shaped to receive a complementarily shaped tool for moving the adjustment member in the first direction. For example, the adjustment member may contain a hexagonal recess to receive a hex key, or a star-shaped recess to receive a hexalobular tool such as those marketed under the trade mark TORX. An unusually-shaped recess or projection can be advantageous in prevention of tampering since a child is unlikely to be in possession of a tool with an appropriately shaped head.

In a particularly preferred embodiment, the adjustment member includes a tool-receiving portion containing the tool-engaging surface, the tool-receiving portion being detachably engaged with a tooth portion which includes the asymmetric teeth. In this embodiment, the tool-engaging surface is preferably a recess, the recess having an inner diameter and a base, the base including an aperture through which a pushing force may be applied to disengage the tooth portion from the stop or stops to release the ratchet means. Since the aperture will be narrower than the inner diameter of the recess, a different disengagement tool, for example a metal pin of appropriate length, having correspondingly smaller diameter would be required to be inserted into the aperture to disengage the tooth portion and decrease the spring tension. The requirement of a separate disengagement tool, or a specialised tool having a disengagement member at the end opposite the end which is received by the tool-receiving portion, further safeguards the hinge against tampering by children.

In one embodiment, the body portion includes an internal flange having a first surface for seating the tool-receiving portion of the adjustment member. The or each stop may be located on a second surface of the internal flange located opposite the first surface.

The or each stop may be an asymmetric tooth having an inclined face over which the first inclined face of each tooth of the tooth portion is adapted to slide.

The tooth portion may include a slot or recess to receive one end of the biasing means to engage the biasing means with the adjustment member.

In another aspect, the present invention provides a kit of parts for a hinge, including:

first and second hinge members movable, in use, between an open position and a closed position, the first hinge member including a substantially cylindrical body portion having a longitudinal axis about which the second hinge member is rotatable to move the hinge between the open position and the closed position; and biasing means housable within the body portion and having a first end and a second end, the first end being fixable relative to the second hinge member and the second end being engageable with an adjustment member, the adjustment member being fixed with respect to the first hinge member;

wherein the adjustment member includes a ratchet means, preferably a releasable ratchet means, to move the adjustment member in a first direction to increase the tension in the biasing means.

BRIEF DESCRIPTION OF THE DRAWINGS

Preferred embodiments of the invention will now be described by way of non-limiting example only by reference to the accompanying drawings, in which.

DESCRIPTION OF PREFERRED EMBODIMENT

Figure 2:
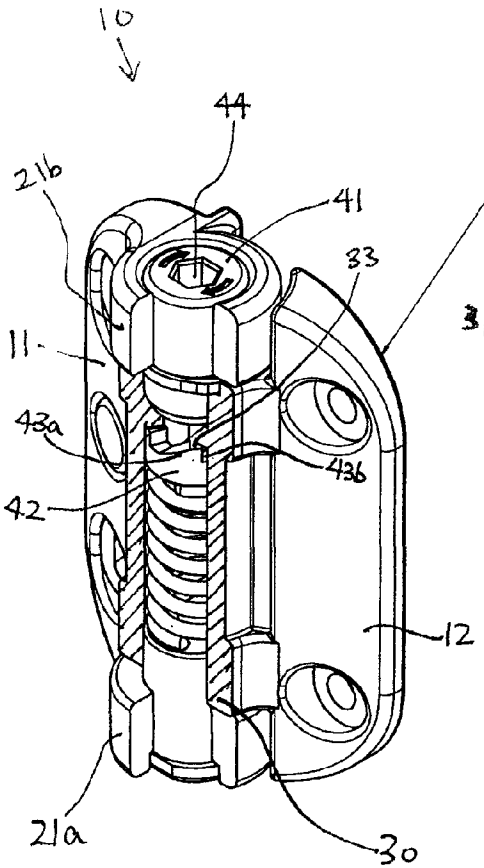
FIG. 2 is a partially cut-away perspective view of the hinge of FIG. 1.
Figure 1:
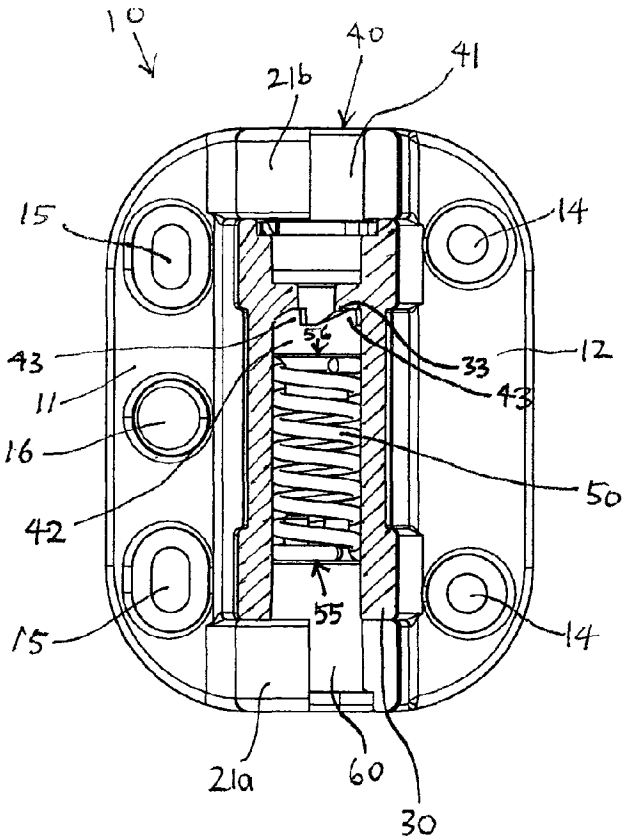
FIG. 1 is a partially cut-away plan view of a hinge according to the present invention.

Referring now to FIGS. 1 and 2, there is shown a hinge 10 in its closed position, having first hinge member 12 and second hinge member 11. The hinge 10 has holes 14, 15 for receiving fasteners, for example bolts, to secure the first and second hinge members to a post and gate (not shown), respectively. It will also be appreciated that the hinge can be used with a door, with the first hinge member 12 being mountable to the door frame and the second hinge member 11 being mountable to the door.

The holes 15 are preferably of elongate form to allow some adjustment of the height of the hinge relative to the gate or door during installation. Once the hinge is positioned appropriately, a further fastener can advantageously be attached through hole 16 to prevent movement of the hinge under the weight of the door or gate.

The first hinge member 12 has a substantially cylindrical body portion 30. The second hinge member 11 may rotate about the longitudinal axis of the body portion 30 in order for the hinge to move between the closed and open position.

Figure 4:
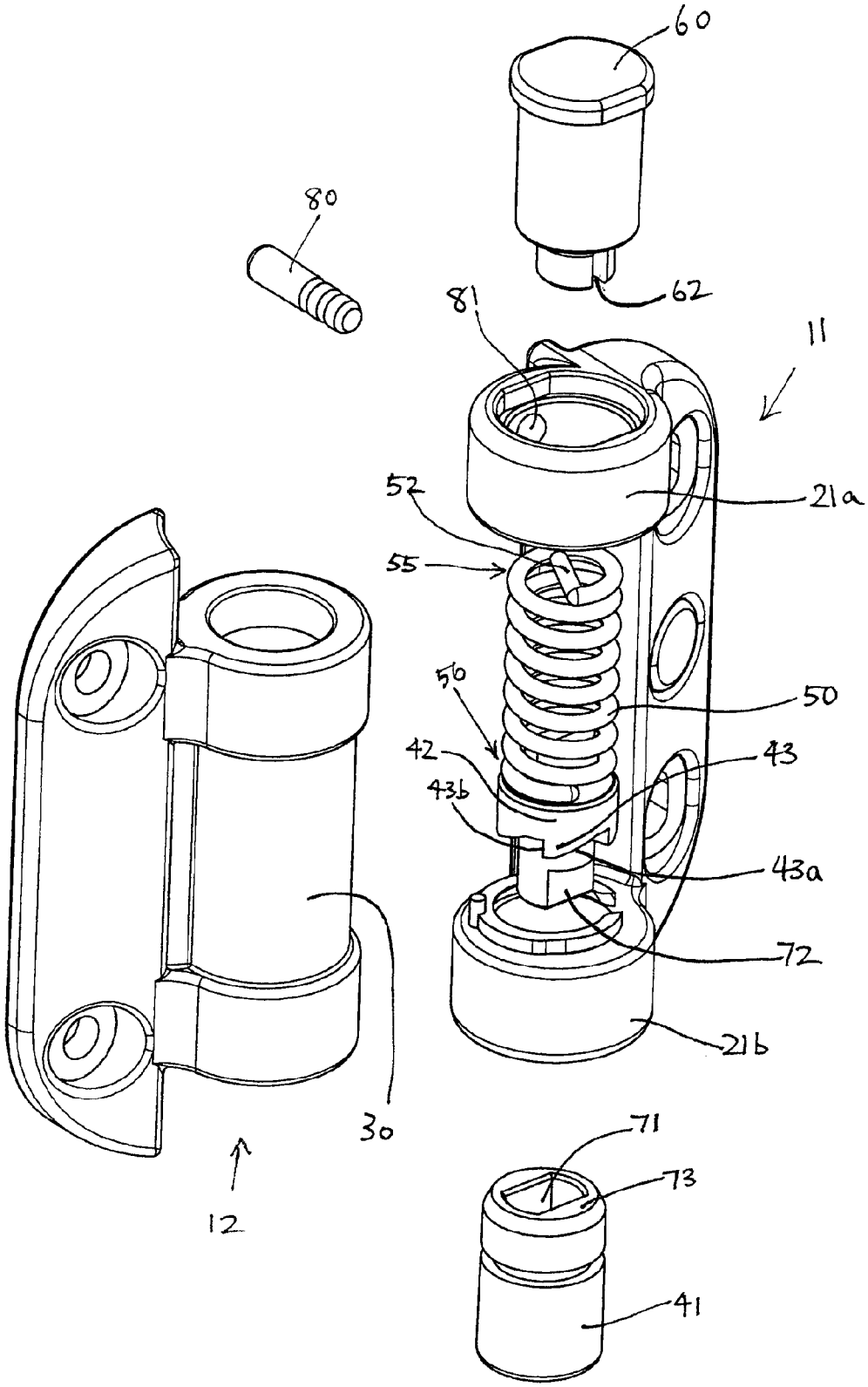
FIG. 4 is a partial exploded view of the hinge of FIGS. 1 and 2.

The second hinge member 11 has a pair of collars 21*a*, 21*b*, one at each end. As best shown in FIG. 4, collar 21*a* acts as a sleeve for end piece 60, which is engaged with the flattened terminal segment 52 of a first end 55 of a biasing means 50, via slot 62. The biasing means 50 of the embodiments shown in the Figures is a helical spring.

End piece 60 also has a hole (not shown) to receive a pin or bolt (or any other suitable fastener) 80. When the hinge is assembled, pin or bolt 80 passes through the hole 81 in collar 21*a* into the hole in end piece 60 to secure end piece 60 to collar 21*a*. A first end 55 of the helical spring 50 is thus fixed with respect to the end of the second hinge member 11.

The second end 56 of helical spring 50 also has a flattened terminal segment (not shown) which fits into a slot (also not shown) in a tooth portion 42 of an adjustment member 40 (FIG. 1), which also has a tool-receiving portion 41. The adjustment member 40 is fixed with respect to the first hinge member 12 by virtue of the engagement of the second face 43*b* (FIG. 2) of at least one of the teeth 43 with one of the stops 33. Stops 33 are asymmetric teeth located on the lower surface of a flange 31 which is located on the inner surface of the body portion 30 of first hinge member 12.

Since opposite ends 55, 56 of the helical spring are fixed with respect to respective hinge members 12, 11, rotational movement of the hinge members with respect to each other, for example by opening a gate to which the hinge 10 is attached, will tend to create a torsional restoring force to move the hinge 10 back to its original (i.e. closed) position.

In FIGS. 1 and 2 it will be observed that the asymmetric teeth 43 have an inclined face 43*a*. When a hex key (not shown) of appropriate dimensions is placed in the hexagonal recess 44 of the tool-receiving portion 41 of adjustment member 40 and turned clockwise (as indicated by the arrows on tool-receiving portion 41), the inclined faces 43*a* of teeth 43 will slide over the inclined faces 33*a* of stops 33, thereby compressing the spring 50 and increasing the longitudinal and torsional components of the tension as they do so. When the second faces 43*b* of teeth 43 pass the ends of the inclined faces 33*a* of the stops 33, the longitudinal component will decompress the spring 50 in the longitudinal direction, but the spring 50 is restrained from decompression in the torsional direction as the teeth 43 bear against the second faces 33*b* of the stops 33.

The teeth 43 of the adjustment member 40 thus act as a ratchet means by allowing rotational movement of the adjustment member 40 in one direction only (in this example, the clockwise direction).

The second faces 33*b*, 43*b* need not be non-inclined faces as shown in the Figures. Angled faces could also provide the ratcheting mechanism described above.

Figure 3:
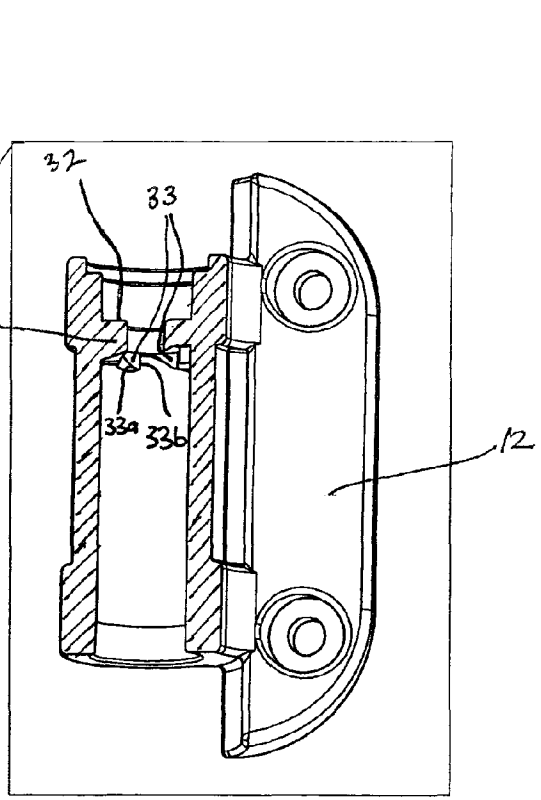
FIG. 3 is a cross-section through one of the hinge members of FIG. 2.

Referring now to the exploded view of FIG. 4, it will be seen that the tool-receiving and tooth portions 41, 42 of adjustment member 40 can be formed as two separate parts to form a releasable ratchet means. The portions 41, 42 are engaged via the placement of boss 72 of tooth portion 42 in the corresponding aperture 71 of tool-receiving portion 41. In the assembled hinge, the lower surface 73 of tool-receiving portion 41 sits on the upper surface 32 of the flange 31 (FIG. 3), while the teeth 43 of tooth portion 42 bear against the teeth 33 on the lower (opposite) surface of flange 31.

The recess 44 has a substantially flat base in which is formed an aperture or bore (not shown), the aperture having smaller diameter than the recess 44 and passing through tool-receiving portion 41. A tool having sufficiently small diameter may then be inserted into the aperture and a compression force applied to the boss 72 of tooth portion 42. This serves to disengage the teeth 43 from stops 33, allowing the spring 50 to snap back to its original position.

Although it is of course highly advantageous for the teeth 43 and stops 33 to be located directly adjacent the tool-receiving portion 41 for efficient transfer of force to the ratchet means, the skilled person will appreciate that other arrangements are possible in which the teeth 43 and stops 33 are located at the end opposite the tool-receiving portion 41. For example, tooth portion 42 could be in engagement with end portion 60 and the first end 55 of spring 50. A shaft (for example, a much more elongate version of the boss 72) passing through the centre of spring 50 and in engagement with tool-receiving portion 41 would be used to transmit force to the ratchet means. The second end 56 of spring 50 could be fixed with respect to hinge member 11 by any suitable means, for example by providing a sleeve around tool-receiving portion 41, the sleeve being adapted to receive the second end 56.

It will be appreciated that many other modifications of the specific embodiments described herein are possible without departing from the scope of the present invention, as defined by the claims appended hereto. For example, the roles of the first and second hinge members may be reversed with suitable rearrangement of the internal components. The terminal segments 52 of the spring 50 need not be transverse to the axis of the cylindrical body portion 30 as shown, but may be aligned longitudinally to fit into recesses in end portion 60 and tooth portion 42. End portion 60 could also be replaced with a second adjustment member to provide additional scope to adjust the spring tension. The number of teeth 43 on tooth portion 42 is not fixed, and indeed may be increased to provide even finer stepped adjustment of the tension, if so desired.

What is claimed is:

1. A hinge including first and second hinge members movable between an open position and a closed position, the first hinge member including a substantially cylindrical body portion having a longitudinal axis about which the second hinge member is rotatable to move the hinge between the open position and the closed position; the body portion housing biasing means having an end fixed relative to the second hinge member, the biasing means is in engagement with an adjustment member, the adjustment member is fixed with respect to the first hinge member; the adjustment member includes a ratchet means to move the adjustment member in a first direction to increase the tension in the biasing means; wherein the ratchet means includes a plurality of asymmetric teeth, each of the teeth having a first inclined face which is adapted to slide in the first direction over one or more stops located on the internal surface of the body portion, and a second face which is engageable with any one of the stops to fix the position of the second end of the biasing means relative to the first hinge member;

the adjustment member includes a tool-engaging surface shaped to receive a complementarily shaped tool for moving the adjustment member in the first direction and a tool-receiving portion containing the tool-engaging surface, the tool-receiving portion is detachably engaged with a tooth portion which includes the asymmetric teeth, the tool-engaging surface is a recess, the recess having an inner diameter and a base, the base including an aperture through which a pushing force is applied to disengage the tooth portion from the stop or stops to release the ratchet means.

2. A hinge according to claim 1, wherein a first end of the biasing means is fixed relative to the second hinge member and a second end of the biasing means is engaged with the adjustment member.

3. A hinge according to claim 1, wherein the body portion includes an internal flange having a first surface for seating the tool-receiving portion of the adjustment member.

4. A hinge according to claim 3, wherein the or each stop is located on a second surface of the internal flange located opposite the first surface.

5. A hinge according to claim 1, wherein the or each stop is an asymmetric tooth having an inclined face over which the first inclined face of each tooth of the tooth portion is adapted to slide.

6. A hinge according to claim 1, wherein the tooth portion includes a slot or recess to receive the second end of the biasing means.

* * * * *